US006691334B2

(12) United States Patent
St-Hilaire

(10) Patent No.: US 6,691,334 B2
(45) Date of Patent: Feb. 17, 2004

(54) SWIMMING POOL COVERING STRUCTURE

(76) Inventor: Stéphane St-Hilaire, 2650, rue Soleil, Chertsey, Québec (CA), J0K 3K0

( * ) Notice: Subject to any disclaimer, the term of this patent is extended or adjusted under 35 U.S.C. 154(b) by 0 days.

(21) Appl. No.: 10/366,507

(22) Filed: Feb. 14, 2003

(65) Prior Publication Data

US 2003/0177570 A1 Sep. 25, 2003

(30) Foreign Application Priority Data

Feb. 14, 2002 (GB) ..... 0203455

(51) Int. Cl.[7] ..... E04H 4/00
(52) U.S. Cl. ..... 4/498; 4/503; 4/504
(58) Field of Search ..... 4/498, 500–504

(56) References Cited

U.S. PATENT DOCUMENTS 3,344,440 A * 10/1967 Langer ..... 4/503
5,924,144 A * 7/1999 Peterson ..... 4/503

* cited by examiner

*Primary Examiner*—Tuan N. Nguyen

(57) ABSTRACT

A swimming pool covering structure including a flexible covering section for extending across the top surface of water contained within the pool and a flexible anchoring section for extending peripherally and outwardly from the covering section. The covering and anchoring sections are separable from each other about a separation segment. The covering and anchoring sections are releasably attached together about the separation segment. The anchoring segment is anchored to an outer structural component positioned outwardly relative to the inner surface of the pool peripheral wall.

37 Claims, 8 Drawing Sheets

SWIMMING POOL COVERING STRUCTURE

FIELD OF THE INVENTION

The present invention relates to the general field of swimming pool accessories and is particularly concerned with a swimming pool covering structure.

BACKGROUND OF THE INVENTION

Swimming pools are already relatively common in most industrialized countries, especially in suburban areas. Recent trends towards the so-called leisure society and increased awareness about the benefits of physical exercises, have led to a concurrent trend towards purchasing of home swimming pools, both of the above and inground type.

Unfortunately, residential pools, whose number has been growing at a steadily increasing rate are linked to the death by drowning of young children as well as adults. Indeed, it has long been recognized that there can be danger, especially for young children, from having an inground or above ground swimming pool on one's property. Although pool related accidents are a known fact, every year children, pets and older individuals still drown in unmonitored swimming pools.

There has been a well recognized need to procure a safety mechanism ensuring that swimming pools, and particularly residential swimming pools are safe. Accordingly, there has long been a need for a swimming pool safety device that can prevent individuals, especially children from accidentally entering the area of and drowning in a swimming pool. Experience has shown that neither fences nor the commonly employed fabric pool covers can prevent access to such pools or offer protection to those who accidentally fall down into them.

Most conventional swimming pools covers are manufactured out of a sheet of plastic material which is slightly larger in length and width than the swimming pool over which it is to be disposed. In use, the swimming pool cover is suspended over the desired swimming pool so that the other periphery of the swimming pool cover rests outside the swimming pool and preferably on a flat surface, such as the top surface of a pool edge or deck.

The sheet of plastic material is typically maintained in place over the swimming pool by disposing weighted objects, such as sand bags or water bags, on top of the periphery of the swimming pool cover. Although widely used, such prior art plastic pool covers of the type described above, experience numerous disadvantages.

For example, conventional swimming pool covers are typically heavy and bulky thereby rendering the placement of the swimming pool cover over a swimming pool a time consuming and physically strenuous task. Also, some prior art swimming pool covers tend to collect large quantities of water over prolonged periods of time. As a consequence, the collected water tends to weigh down the swimming pool cover making its removal even more difficult.

Another main drawback associated with prior art swimming pool covers relate to their anchoring structures for anchoring the swimming pool cover in a substantially taut state over the swimming pool. Indeed, in order to be efficient, most swimming pool covers must be stretched relatively tightly across the top of the swimming pool so that the material of the covers are taut or maintained under tension. In order to accomplish this, most prior art swimming pool covers require a number of particularly complicated anchoring devices. Accordingly, there exists a need for an improved swimming pool safety cover.

SUMMARY OF THE INVENTION

It is a general object of the present invention to provide an improved swimming pool safety cover. Advantages of the present invention include that the proposed swimming pool cover reduces the risks of having an individual, in particular a child, accidentally or otherwise fall and drown into an unmonitored pool.

Also, the proposed swimming pool safety cover is specifically designed so as to be easily installable and retractable over and from various types of swimming pools, such as rigid and inflatable above-ground swimming pools as well as in-ground swimming pools through a set of quick, easy and ergonomic steps without requiring special tooling or manual dexterity.

Furthermore, the proposed swimming pool cover is designed so as to be installable on most conventional swimming pools with reduced risks of damaging the latter. Also, the proposed swimming pool cover is designed so as to be mountable over swimming pools without considerably reducing their overall aesthetical aspect thereof.

Still further, the proposed swimming pool cover is designed so as to allow water to drip therethrough while still offering adequate retention characteristics for an individual falling thereon. Also, the proposed swimming pool cover is designed so as to be manufacturable using conventional forms manufacturing so as to provide of a swimming pool cover that will be economically feasible, long lasting and relatively trouble free in operation.

In accordance with the present invention, there is provided a swimming pool covering structure for covering a top surface of a volume of liquid contained within a swimming pool, the swimming pool having a pool bottom wall and a pool peripheral wall extending from the pool bottom wall, the pool peripheral wall defining a peripheral wall inner surface and a peripheral wall top edge, the swimming pool also defining an outer structural component positioned outwardly relative to the peripheral wall top edge in a substantially fixed relationship relative to the pool peripheral wall, the swimming pool covering structure comprising: a substantially flexible covering section, the covering section being configured and sized for extending substantially across the top surface, the covering section defining a covering section outer peripheral edge; a substantially flexible anchoring section, the anchoring section being configured and sized for extending peripherally and outwardly from the covering section, the anchoring section defining an anchoring section inner peripheral edge and an anchoring section outer peripheral edge, the covering and anchoring sections being separable from each other about a separation segment; a covering-to-anchoring section releasable attachment means extending between the covering and anchoring sections about the separation segment for releasably attaching the covering and anchoring sections together about the separation segment; anchoring means attached to the anchoring segment for anchoring the anchoring segment to the outer structural component.

Conveniently, the covering section defines a covering section central segment and a covering section flange positioned peripherally relative to the covering section central segment, the covering section flange extending from the covering section central segment to the covering section outer peripheral edge.

Typically, the swimming pool covering structure further comprises a releasable locking means operatively coupled to the covering-to-anchoring section releasable attachment means for releasably locking the covering section to the anchoring section.

Conveniently, the swimming pool covering structure further comprises a protective means positioned adjacent the covering-to-anchoring section releasable attachment means for substantially protecting the covering-to-anchoring section releasable attachment means against environmental agents.

Typically, the protective means is positioned, configured and sized so as to releasably cover the covering-to-anchoring section releasable attachment means; whereby the protective means also acts as a contact prevention means for at least partially preventing contact between an intended user and the covering-to-anchoring section releasable attachment means and as an esthetic enhancing means for enhancing the visual aspect of the swimming pool covering structure.

In at least one embodiment of the invention, the swimming pool covering structure further comprises a solar membrane attached thereto so as to extend between the covering section and the top surface of the volume of liquid when the covering section is deployed over the top surface of the volume of liquid.

Typically, the anchoring section defines an anchoring section proximal segment located proximally relative to the covering section and an anchoring component distal segment located distally relative to the covering section; the anchoring section proximal and distal segments being foldable relative to each other about a proximal-to-distal segment fold line; the anchoring section being configured and sized so as to be folded about the proximal-to-distal segment fold line with the anchoring section distal segment located below the peripheral wall top edge when the anchoring section is attached to the outer structural component.

In accordance with the present invention, there is also provided, in combination, a swimming pool and a swimming pool covering structure for covering a top surface of a volume of liquid containable within the swimming pool, the swimming pool having a pool bottom wall and a pool peripheral wall extending from the pool bottom wall, the pool peripheral wall defining a peripheral wall inner surface and a peripheral wall top edge, the swimming pool also defining an outer structural component positioned outwardly relative to the peripheral wall top edge in a substantially fixed relationship relative to the pool peripheral wall, the swimming pool covering structure comprising: a substantially flexible covering section, the covering section being configured and sized for extending substantially across the top surface, the covering section defining a covering section outer peripheral edge; a substantially flexible anchoring section, the anchoring section being configured and sized for extending peripherally and outwardly from the covering section, the anchoring section defining an anchoring section inner peripheral edge and an anchoring section outer peripheral edge, the covering and anchoring section being separable from each other about a separation segment; a covering-to-anchoring section releasable attachment means extending between the covering and anchoring sections about the separation segment for releasably attaching the covering and anchoring sections together about the separation segment; anchoring means attached to the anchoring segment for anchoring the anchoring segment to the outer structural component.

BRIEF DESCRIPTION OF THE DRAWINGS

Various embodiments of the present invention will not be disclosed, by way of example, in reference to the following drawings in which:

FIG. 3, in a partial perspective view, illustrates part of a releasable attachment mechanism used for releasably attaching, covering and anchoring sections part of the swimming pool covering structure shown in FIGS. 1 and 2;

DETAILED DESCRIPTION OF THE PREFERRED EMBODIMENT(S)

Figure 1:
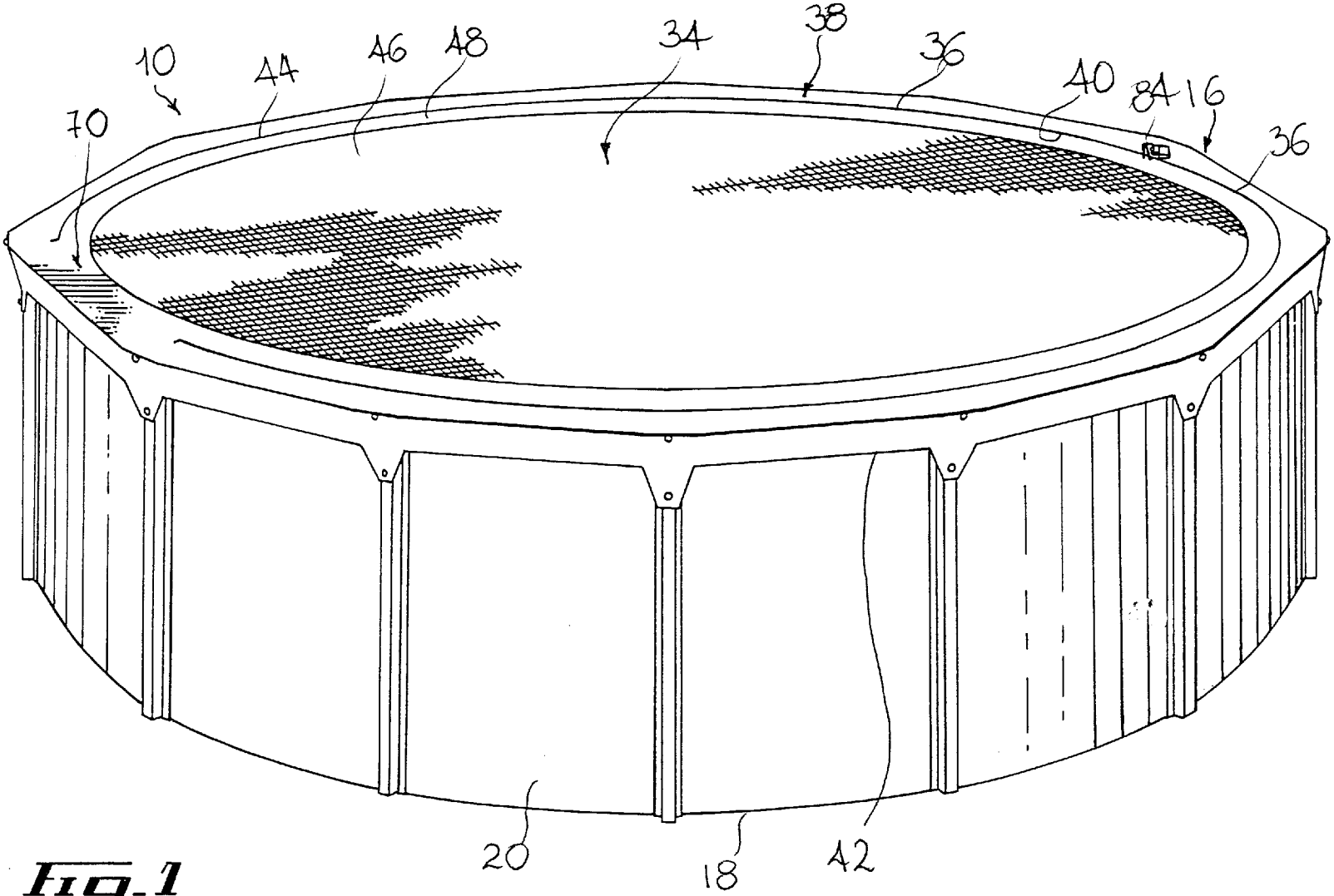
FIG. 1, in a perspective view illustrates a swimming pool covering structure in accordance with an embodiment of the present invention mounted in a covering configuration on a conventional above-ground swimming pool.

Referring to FIG. 1, there is shown a swimming pool covering structure 10 in accordance with a first embodiment of the present invention. The swimming pool covering structure 10 is typically used for covering the top surface 12 (shown in FIGS. 2 and 4) of the volume of liquid 14 (also shown in FIGS. 2 and 4) contained within a swimming pool 16 or other water containing structures such as a spa, a bath tub, a jacuzzi of the like. Hence, it should be understood that, although the swimming pool covering structure is shown throughout the figures as being used in combination with various types of swimming pool, the swimming pool covering structure could be used for other purposes and/or in other contexts without departing from the scope of the present invention.

The swimming pool 16 has a pool bottom wall 18 and a pool peripheral wall 20 extending from the pool bottom wall 18. As shown more specifically in FIG. 4, the pool peripheral wall 20 defines a peripheral wall inner surface 22 and a peripheral wall top edge 24. In the embodiment shown in FIGS. 1 through 4 and 11 through 13, the pool peripheral wall 20 includes a rigid peripheral frame 26 and an inner pool membrane 28 attached thereto as is well known in the art. It should however be understood that other types of pool constructions could be used without departing from the scope of the present invention.

The swimming pool 16 also defines an outer structural component 30 positioned outwardly relative to the peripheral wall top edge 24 in a substantially fixed relationship relative to the pool peripheral wall 20. In the embodiments shown in FIGS. 1 through 4 and 11 through 13, the swimming pool 16 further includes a peripheral pool rim 32. In such instances, the outer structural component 30 may be defined as a segment of the pool rim 32 protruding outwardly from the pool peripheral wall 20. It should be understood that the outer structural component 30 may take any suitable form without departing from the scope of the present invention. For example, in the embodiment shown in FIGS. 5 through 7, the outer structural component 30 includes attachment pins secured to the outer surface of the pool peripheral wall 20. In the embodiment shown in FIGS. 8 through 10, the outer structural component 30 includes the ground surface located adjacent the in-ground swimming pool.

The swimming pool covering structure 10 includes a substantially flexible covering section 34. The covering section 34 is configured and sized for extending substantially across the top surface 12. Typically, although by no means exclusively, the covering section 34 is configured and sized so as to extend substantially across the top surface 12 when in a substantially taut state. The covering section 34 defines a covering section outer peripheral edge 36.

The swimming pool covering structure 10 also includes a substantially flexible anchoring section 38. The anchoring section 38 is configured and sized for extending peripherally and outwardly from the covering section 34. The anchoring section 38 defines an anchoring section inner peripheral edge 40 and an anchoring section outer peripheral edge 42.

Figure 2:
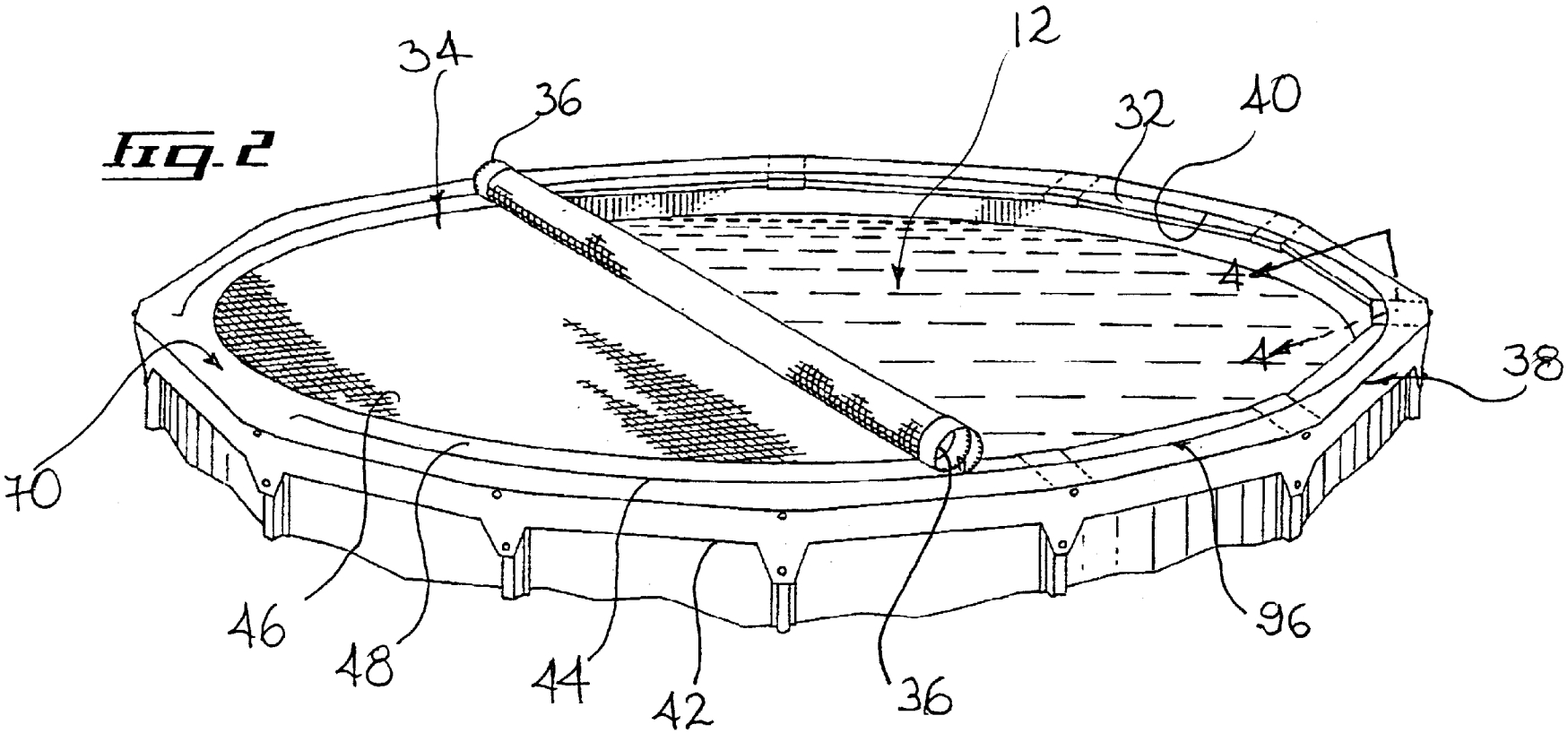
FIG. 2, in a partial perspective view with sections taken out, illustrates the swimming pool covering structure shown in FIG. 1 having a covering section thereof in a partially removed configuration.

As shown more specifically in FIG. 2, the covering and anchoring sections 34, 38 are separable from each other about a separation segment 44. FIG. 2 illustrates a situation wherein the covering section 34 is being rolled upon itself as it separates from the anchoring section 38 remaining stationary and fixed to the swimming pool 16. It should be understood that the covering section 34 could be otherwise separated from the anchoring section 38 without departing from the scope of the present invention.

The swimming pool covering structure 10 also includes a covering-to-anchoring section releasable attachment means extending between the covering and anchoring sections 34, 38 about the separation segment 44 for releasably attaching the covering and anchoring sections 34, 38 together about the separation segment 44. It should be understood that although the covering section 34 is shown as having a generally disc-shape configuration and the separation segment as having an accordingly annular shaped configuration, the covering section 34 and separation segment 44 could have other configurations without departing from the scope of the present invention.

The swimming pool covering structure 10 further includes an anchoring means attached to the anchoring section 38 for anchoring the anchoring section 38 to the outer structural component 30. It should be understood that, although the anchoring section 38 is shown as having a generally annular configuration, the anchoring section 38 could have other configurations without departing from the scope of the present invention.

Typically, the covering section 34 defines a covering section central segment 46 and a covering section flange 48 positioned peripherally relative to the covering section central segment 46. The covering section flange 48 typically extends from the covering section central segment 46 to the covering section outer peripheral edge 36.

Typically, the covering section central segment 46 and the covering section flange 48 are made out respectively of a central segment piece of material and of a distinct flange piece of material. In such situations, the central segment piece of material and the flange piece of material are attached together using a central segment-to-flange attachment means. Typically, the central segment-to-flange attachment means includes stitches extending between the central segment piece of material and the flange piece of material.

Figure 4:
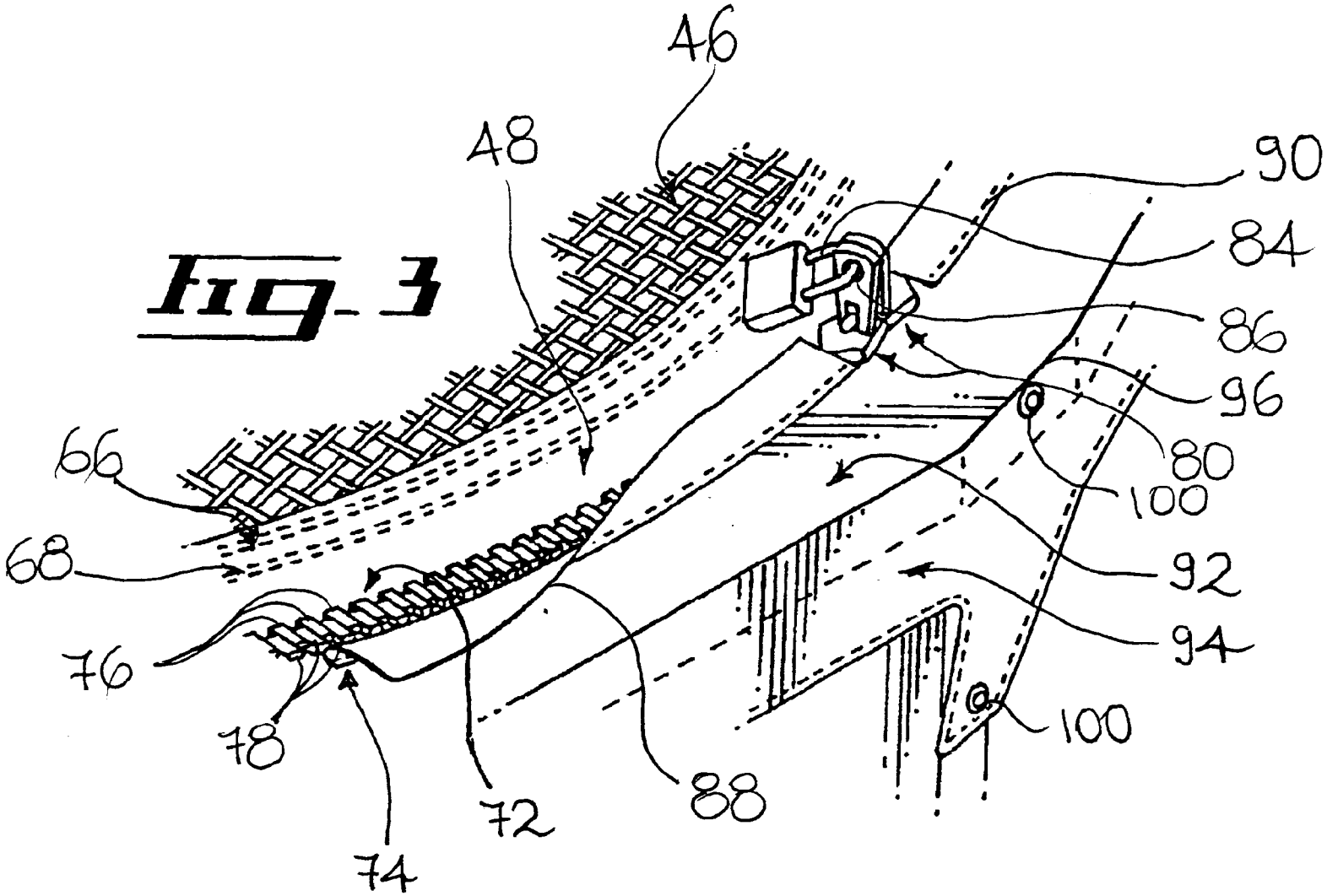
FIG. 4, in a partial cross-sectional view taken along arrows 4—4 of FIG. 2, illustrates anchoring components used for anchoring the swimming pool covering structure shown in FIGS. 1 through 3 to the corresponding above-ground swimming pool.
Figure 4:
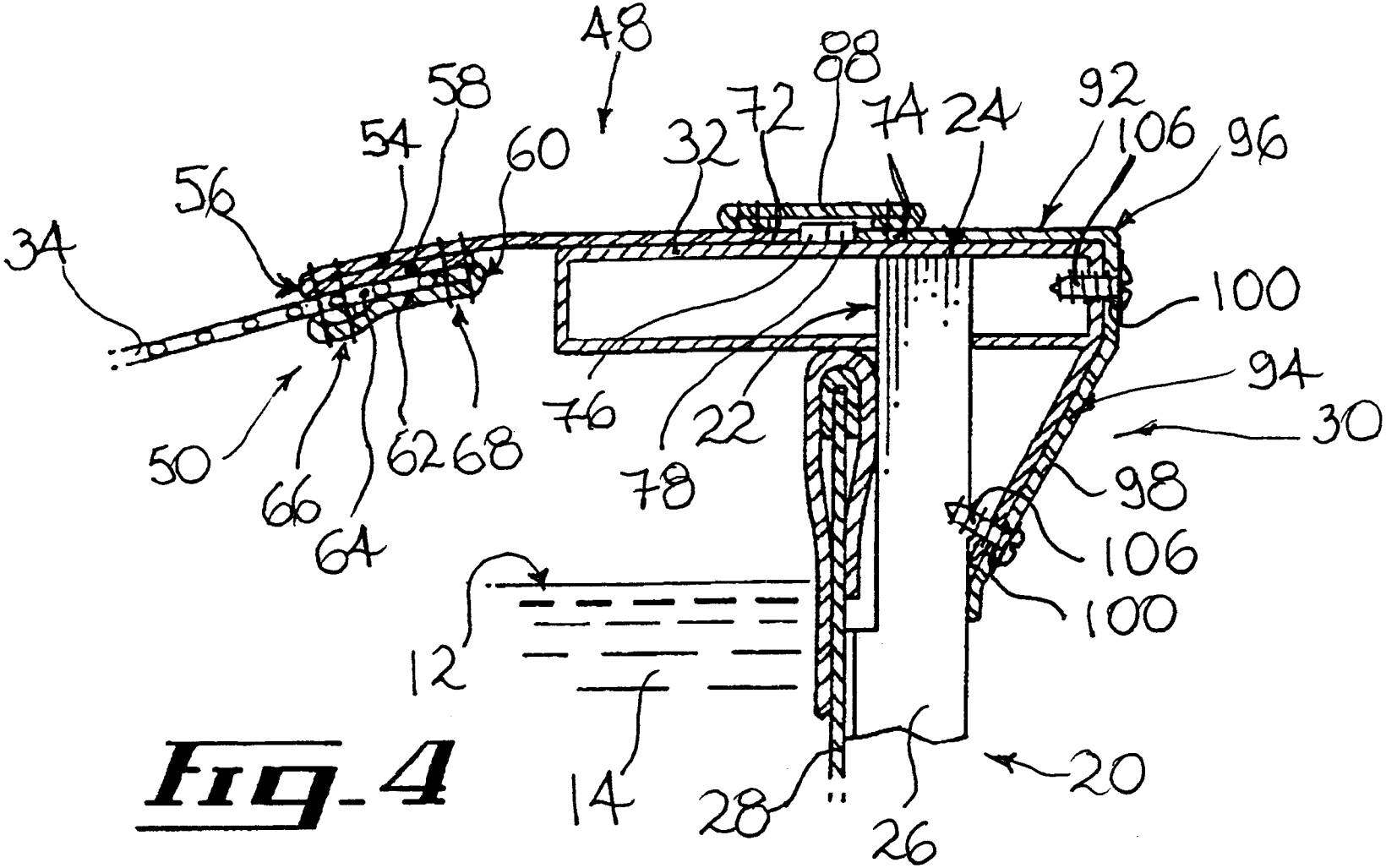

As shown more specifically in FIG. 4, the covering section flange 48 typically defines a flange inner peripheral edge 50 located generally opposite the covering section outer peripheral edge 36. Also, the covering section central segment 34 typically defines a central segment peripheral edge 52.

Typically, the covering section flange 48 is folded on itself adjacent the flange inner peripheral edge 50. The covering section flange 48 defines an inwardly directed first layer 54 folding about an inner fold line 56 into an outwardly directed second layer 58. The second layer 58 folds about an outer fold line 60 into an inwardly directed third layer 62. The first, second and third layers 54, 58 and 62 are typically substantially in register with each other.

The covering section central segment 34 defines a central segment attachment area 64 located adjacent the central segment peripheral edge 36. The central segment attachment area 64 is typically sandwiched between the second and third layers 58, 62. Typically, although by no means exclusively, the first, second and third layers 54, 58 and 62 are attached together using a first and a second pair of stitch lines 66, 68.

Alternatively, in an embodiment of the invention not shown, the covering section central segment 34 and the covering section flange 48 may be made out of an integral piece of material. However, typically, whether a covering section central segment 34 and the covering section flange 48 are made out of distinct material or out of an integral piece of material, the covering sections central segment 34 is preferably made out of a substantially water permeable material such as a mesh screen.

Figure 14:
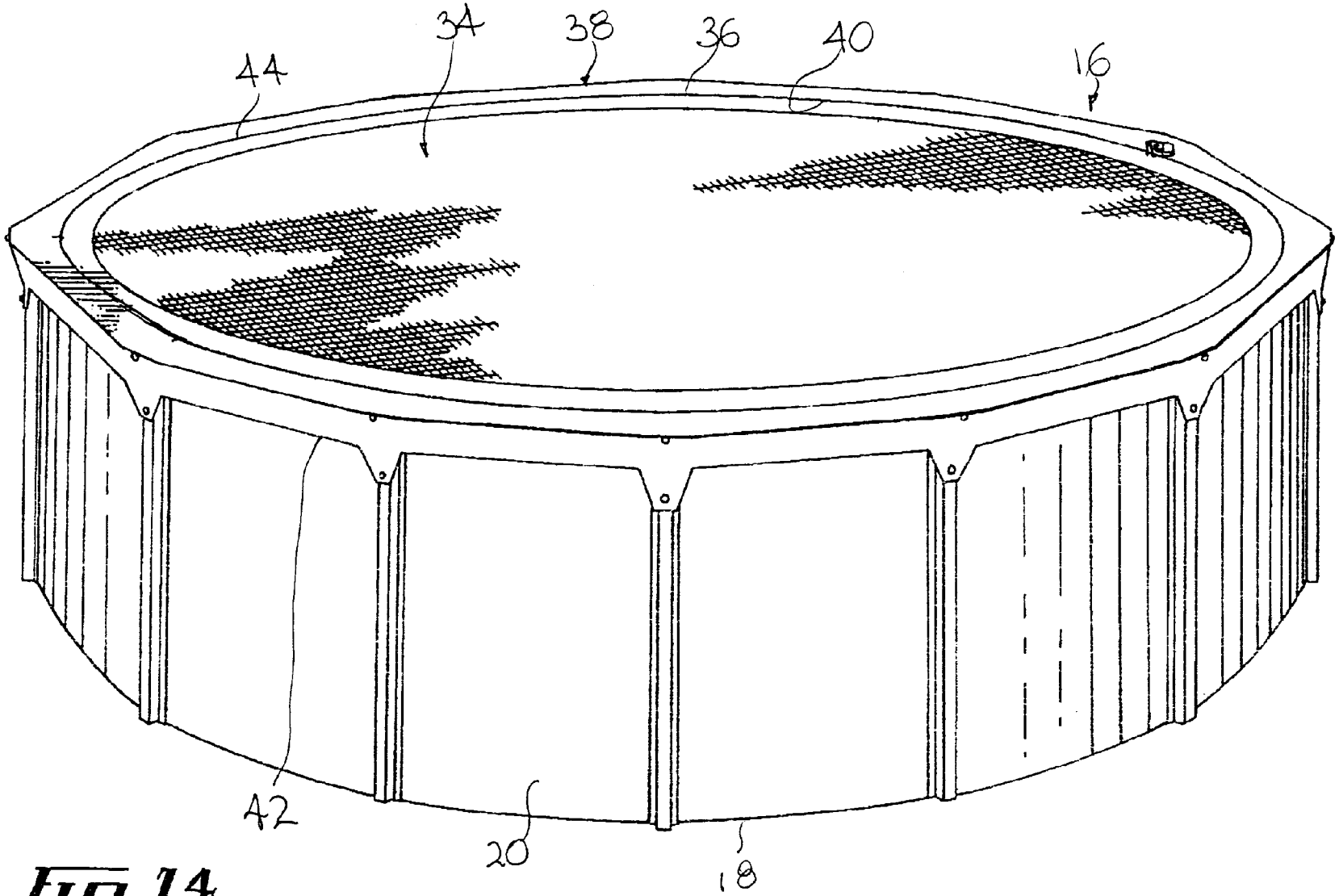
FIG. 14, in a perspective view, illustrates a swimming pool covering structure in accordance with a fifth embodiment of the present invention, the swimming pool covering structure being shown mounted on a rigid-type of above-ground swimming pool.

In the embodiments shown throughout the figures, the separation segment 44 extending between the covering and anchoring sections 35, 38 extends only partially along the covering section outer peripheral edge 36 and, correspondingly, only partially along the anchoring section inner peripheral edge 40. Hence, in the embodiments shown throughout the Figures, the covering and anchoring segments 38 are linked together about a peripheral linking segment 70. Typically, the covering and anchoring segments 34, 38 extend integrally between each other about the linking segment 70. In an alternative embodiment of the invention shown in FIG. 14, the separation segment 44 extends all around the covering section outer peripheral edge 36 allowing the covering section 34 to be fully detachable from the anchoring section 38.

As shown more specifically in FIGS. 3 and 4, the covering-to-anchoring releasable attachment means typically includes a zip-fastener including a first and a second flexible zipper strip 72, 74 respectively attached to the covering and anchoring sections 34, 38. As is well known in the art, the first and second zipper strips 72, 74 are respectively provided with interlocking first and second zip projections or teeth 76, 78 extending therefrom. The zip fastener also includes conventional pull tab components 80 operatively connected to the first and second projections 76, 78 for opening and closing the zip fastener by sliding the pull tab component 80 along the first and second zipper strips 72, 74.

The swimming pool covering structure 10 is optionally further provided with a releasable locking means operatively coupled to the covering-to-anchoring section releasable attachment means for releasably locking the covering section 34 to the anchoring section 38. The releasable locking means may take any suitable form. In the embodiments shown throughout the Figures, the releasable locking means includes providing the zip fastener with a pair of pull tab components 80 and providing the covering-to-anchoring section releasable attachment means with a pull tab releasable locking means for releasably locking the pull tabs together with the zip fastener is closed. Typically, although by no means exclusively, the pull tab releasable locking means includes a padlock 82 having a padlock ring 84 insertable through corresponding pull tab apertures 86 formed in the prehension sections of the pull tab components 80.

The swimming pool covering structure 10 is optionally further provided with a protective means positioned adjacent the covering-to-anchoring anchoring section releasable attachment means for substantially protecting the covering-to-anchoring section releasable attachment means against environment agents such as the action of debris, of water, or the like. Typically, although by no means exclusively, the protective means is positioned, configured and sized so as to releasably cover the anchoring section releasably attachment means. The protective means may hence optionally act as a contact prevention means for at least partially preventing contact between an intended user and the covering-to-anchoring section releasable attachment means as well as an aesthetic enhancing means for enhancing the visual aspect of the swimming pool covering structure.

In the embodiments shown throughout the Figures, the protective means includes a covering flap 88 attached to the swimming pool covering structure 10 adjacent the zip fastener for selectively covering the first and second zip projections or teeth 76, 78. Typically, although by no means exclusively, the covering flap 88 is attached by stitch lines 90 to the second zipper strip 74 so as to be pivotable relative thereto. The covering flap 88 may hence by used for protecting the first and second zip projections 76, 78 against debris that may hinder their use.

The covering flap 88 also prevents contact of the intended user with the first and second zip projections or teeth 76, 78 hence reducing the risks of scratches and from being burnt by the first and second zip projections 76, 78 in the even that the latter, being made out of a metallic material or the like, become hot under the action of the sun. Furthermore, the covering flap 88, by selectively covering the first and second zip projections 76, 78, selectively improves the overall esthetical aspect of the swimming pool covering structure 10.

Typically, the anchoring section 38 defines an anchoring section proximal segment 92 located proximally relative to the covering section 34 and an anchoring section distal segment 94 located distally relative to the covering section 34. The anchoring section proximal and distal segments 92, 94 are typically foldable relative to each other about the proximal-to-distal segment fold line 96. The anchoring section 83 is configured and sized so as to be folded about the proximal-to-distal segment fold line 96 with the anchoring section distal segment 94 located below the peripheral wall top edge 24 when the anchoring section 38 is attached to the outer structural component 30.

In situations such as shown in FIGS. 1 through 4 and 11 through 14 wherein the pool 16 includes a pool rim 32, the anchoring section proximal segment 92 typically extends over the top surface of the pool rim 32 while the anchoring section distal segment 94 extends at an angle relative thereto along an outwardly located anchoring flange 98 part of the pool rim 92.

In the embodiments shown in FIGS. 1 through 4 and 11 through 14, the anchoring means includes at least two and preferably a plurality of circumferentially disposed anchoring apertures 100 formed in the anchoring section 38 for receiving corresponding anchoring components 102 extending from the outer structural component 30.

Typically, the anchoring section 38 is provided with at least two and preferably a plurality of circumferentially disposed anchoring tongues 104 extending outwardly therefrom. Typically, the anchoring means include at least two pairs and preferably a plurality of pairs of anchoring apertures 100 extending through the anchoring section 38. A first anchoring aperture 100' part of each pair of anchoring apertures 100', 100 is typically positioned in a corresponding anchoring tongue 104 while a second anchoring aperture 100 part of each pair of anchoring apertures 100',100 is positioned substantially in register with a corresponding first anchoring aperture 100' and substantially adjacent the proximal-to-distal segment fold line 96.

Throughout the Figures, the anchoring tongues 104 are shown as having a generally frusto-triangular configuration and extending integrally from the remainder of the anchoring section 38. It should be understood that the anchoring tongue 104 could have any suitable configuration and could be made out of a separate piece of material attached to the remainder of the anchoring section without departing from the scope of the present invention.

The anchoring components 102 may take any suitable form. In the embodiments shown in FIGS. 1 through 4 and 11 through 14, the anchoring components include bolts or screws 106 inserted through the anchoring apertures 100 and into the anchoring flange 98 part of the pool rim 32.

In use, the anchoring section 38 is initially anchored to the pool 16 using a suitable anchoring means. The anchoring section 38 may be releasably or fixedly attached to the swimming pool 16. The covering section 34 may then be selectively deployed in a covering configuration as shown in FIG. 1 or retracted such as shown in FIG. 2 for correspondingly preventing and allowing access to the body of water 14. The covering-to-anchoring section releasable attachment means releasably attaches the covering and anchoring sections 34, 38 together for selectively allowing and preventing retraction of the covering section 34. The covering and anchoring sections 34, 38 and associated other components part of the swimming pool covering structure 10 are hence preferably designed so as to be able to sustain structural stresses imparted thereon by attempts at entering into the body of water 14 when the covering section 14 is in its deployed covering configuration.

Figure 6:
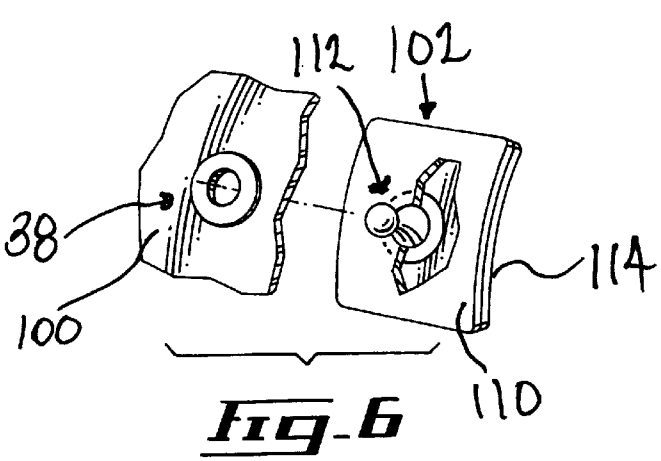
FIG. 6, in a partial exploded view with sections taken out, illustrates part of an anchoring mechanism used for anchoring the swimming pool covering structure shown in FIG. 5 to the corresponding inflatable above-ground swimming pool.
Figure 7:
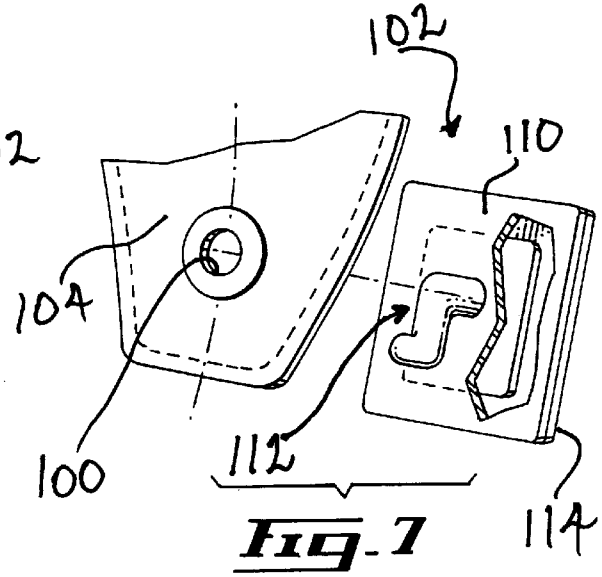
FIG. 7, in a partial exploded view with sections taken out, illustrates another anchoring mechanism used for anchoring the swimming pool covering structure shown in FIG. 5 to the corresponding above-ground inflatable swimming pool.
Figure 5:
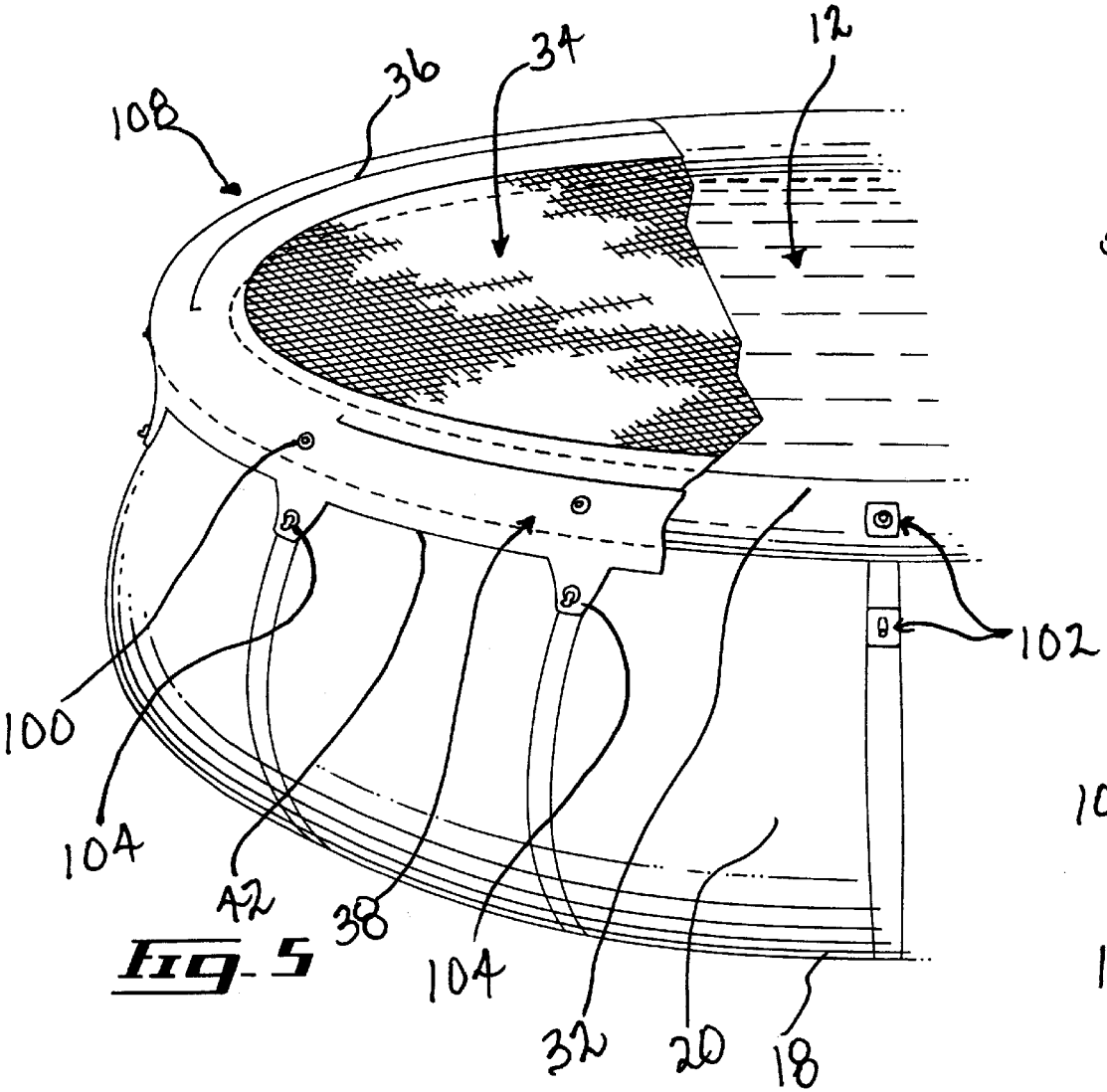
FIG. 5, in a partial perspective view with sections taken out, illustrates the swimming pool covering structure in accordance with a second embodiment of the present invention, the swimming pool covering structure being shown in a covering configuration mounted over an above-ground inflatable type of swimming pool.

Referring now more specifically to FIGS. 5 through 7, there is shown a swimming pool covering structure 108 in accordance with a second embodiment of the present invention. The embodiment 108 is substantially similar to the embodiment 20 and, hence, similar reference numerals will be used to denote similar components. One of the main differences between the embodiment 108 and the embodiment 10 resides in that the embodiment 108 is typically preferred in situations wherein the swimming pool covering structure is to be used with an inflatable-type of above-ground swimming pool. It should, however, be understood that the embodiment 108 could be used in other context with other types of swimming pools without departing from the scope of the present invention.

Also, the anchoring means of the embodiment 108 typically includes at least two and preferably a plurality of anchoring components 102 designed so as to be attachable to the outer structural component 30. As shown in FIG. 5, the anchoring components 102 may be designed so as to be attachable to the outer surface of either or both the pool peripheral wall 20 and/or the pool rim 32.

Each attachable anchoring component 102 is provided with an anchoring component base 110 for attachment to the outer structural component 30. Each attachable anchoring component 102 is also provided with an anchoring component pin 112 extending from the anchoring component base 110. The anchoring component base is typically provided with a double-sided tape 114 or other suitable means for attaching the anchoring component base 110 to the outer structural component 30.

In situations wherein pairs of anchoring components 102 are grouped about the periphery of the anchoring section 38, each pair includes a first anchoring component 102 having a generally rectilinear pin 112 such as shown in FIG. 6 and a second attachment component 102 having a generally S-shaped pin 112 such as shown in FIG. 7. It should be understood that the configuration of the pins 112 could vary without departing from the scope of the present invention.

Figures 8, 9, 10:
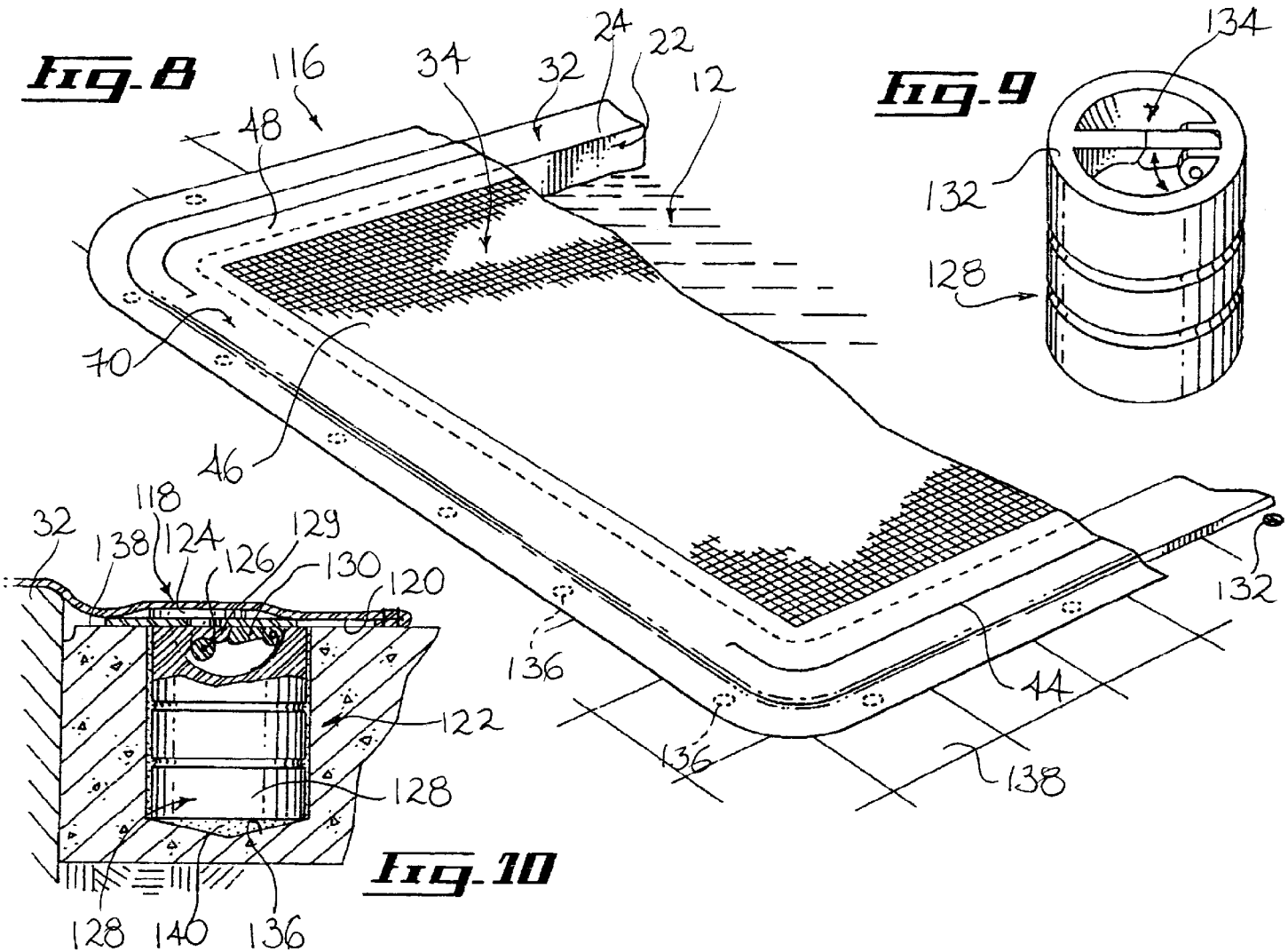
FIG. 8, in a partial perspective view with sections taken out, illustrates a swimming pool covering structure in accordance with a third embodiment of the present invention, the swimming pool covering structure being shown in a covering configuration mounted over an in-ground type of swimming pool.
FIG. 9, in a perspective view, illustrates an anchoring component used for anchoring the swimming pool covering structure shown in FIG. 8 to the structure of the in-ground swimming pool.
FIG. 10, in a partial cross-sectional view with sections taken out, illustrates the anchoring component shown in FIG. 9 anchored into the peripheral structure of the swimming pool shown in FIG. 8.

Referring now more specifically to FIGS. 8 through 10, there is shown a swimming pool covering structure 116 in accordance with a third embodiment of the present invention. The swimming pool covering structure 116 is substantially similar to the swimming pool covering structure 10 and, hence, similar reference numerals will be used to denote similar components.

One of the main differences between the embodiments 116 and 10 is that the embodiment 116 is designed so as to be typically used with in-ground types of swimming pools. It should, however, be understood that the embodiment 116 could be used in other contexts and with other types of swimming pools or water-containing structures without departing from the scope of the present invention. Also, although the embodiment 116 is shown as having a substantially rectangular configuration, it should be understood that the embodiment 116 could have other configurations without departing from the scope of the present invention.

Another difference between the embodiment 116 and the embodiment 10 resides in that the anchoring means typically includes a first anchoring hook 118 extending from an undersurface 120 of the anchoring section 38 and a second anchoring hook 122 attached to the outer structural component 30. The first and second anchoring hooks 118, 122 are configured and sized for releasable attachment together.

Typically, the first anchoring hook 118 includes a first hook base 124 attached to the underside 120 of the anchoring section 38 and a generally U-shaped hooking segment 126 extending from the first hook base 124. The second anchoring hook 122 typically includes a generally cylindrical second hook base 128 insertable within the outer structural component 30. The second anchoring hook 122 also has a fixed anchoring prong 129 and a movable anchoring prong 130 both attached to the second hook base 128.

As shown more specifically in FIGS. 9 and 10, the second hook base 128 typically defines a generally flat hook base top surface 132. The second hook base top surface 132 is typically provided with a cylinder recess 134 formed therein. The anchoring prongs 128, 130 are typically mounted in a proximal relationship relative to each other within the cylinder recess 134.

The movable anchoring prong 130 is pivotally attached to the second hook base 128 within the cylinder recess 134 for pivotable movement between a prong locking configuration wherein the anchoring prong 130 is in a substantially proximal and collinear relationship with the fixed anchoring prong 129 and a prong unlocking configuration wherein the anchoring prong 130 is in a substantially spaced and angled relationship relative to fixed anchoring prong 129.

The movable anchoring prong 130 selectively allows insertion and withdrawal to and from the cylinder recess 134 and, hence, hooking and unhooking of the hooking segment 126 to and from the fixed anchoring prong 129 when in the unlocking configuration. Conversely, the movable anchoring prong 130 selectively prevents insertion and withdrawal to and from the cylinder recess 134 and, hence, hooking and unhooking of the hooking segment 126 to and from the fixed anchoring prong 129 when in the locking configuration.

In use, the cylindrical second hook base 128 is typically inserted within a corresponding anchoring component aperture 136 formed in the floor 138 located adjacent the pool rim 38 and secured thereto using cement 140 or other suitable means. The floor 138 located adjacent the pool rim 38 may hence act as the outer structural component 30 for this specific embodiment. The position, configuration and size of the movable anchoring prong 130 is such that it prevents the protrusion thereof from the second hook base top surface 132 when in both the prong locking and unlocking configurations.

Figure 11:
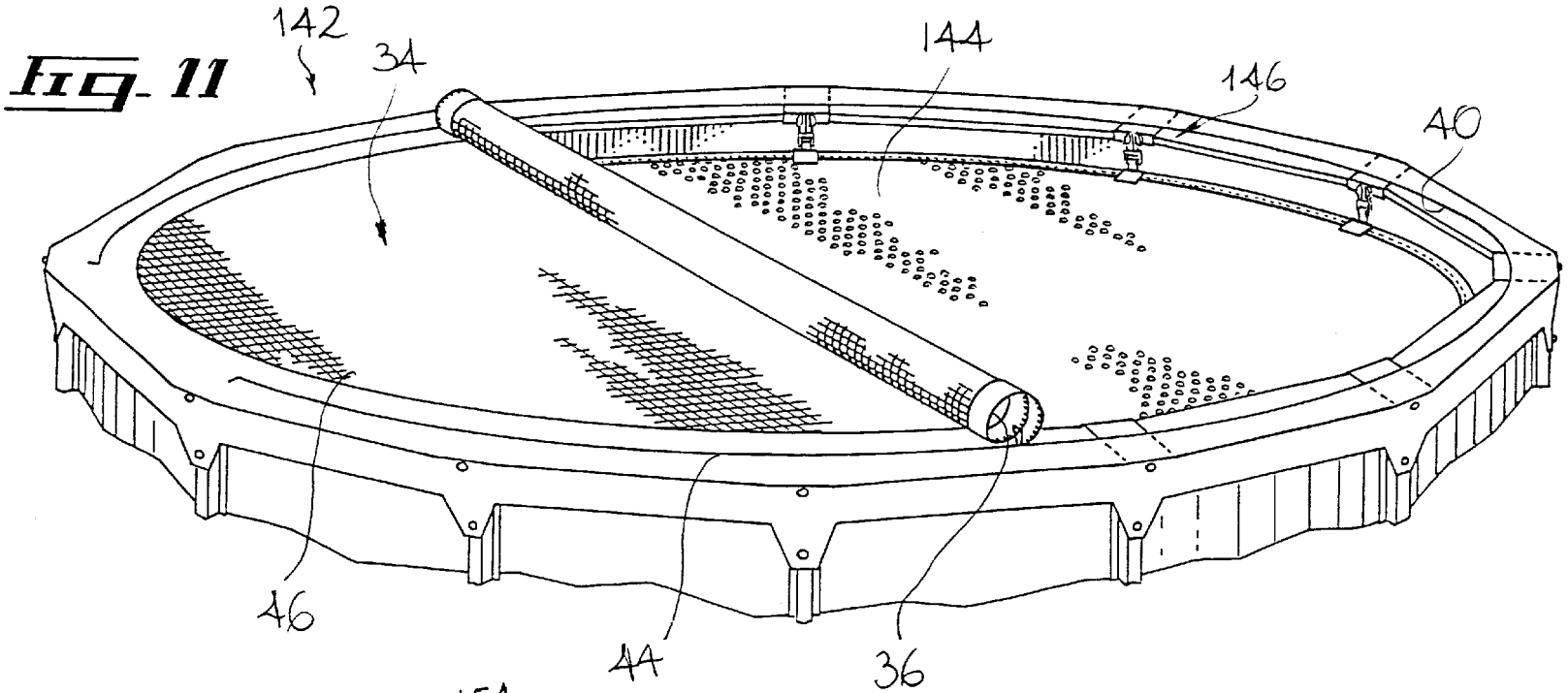
FIG. 11, in a partial perspective view with sections taken out, illustrates a swimming pool covering structure in accordance with a fourth embodiment of the present invention, the swimming pool covering structure being shown with its covering section in a partially retracted configuration mounted over a rigid type of above-ground swimming pool.
Figure 13:
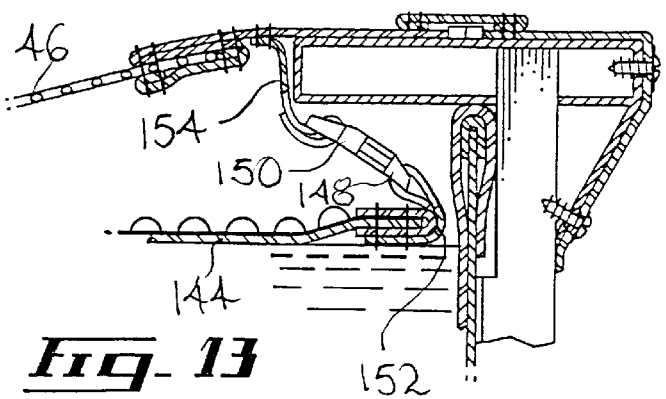
FIG. 13, in a partial cross-sectional view with sections taken out taken along arrows 13—13 of FIG. 11, illustrates the relationship between the solar membrane, the covering section part of the swimming pool covering structure and the swimming pool shown in FIG. 11.
Figure 12:
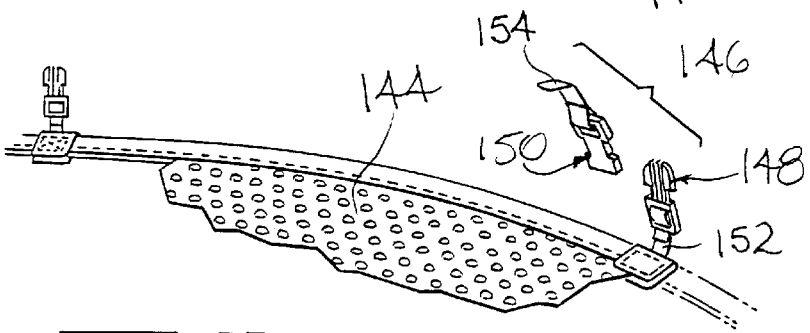
FIG. 12, in a partial perspective view with sections taken out, illustrates part of an attachment mechanism used for attaching a solar membrane part of the embodiment shown in FIG. 11 to the remainder of the swimming pool covering structure.

Referring now more specifically to FIGS. 11 through 13, there is shown a swimming pool covering structure 142 in accordance with a fourth embodiment of the present invention. The embodiment 142 is substantially similar to the embodiment 10 and, hence, similar reference numerals will be used to denote similar components. One of the main differences between the embodiments 142 and 10 resides in the presence of a solar membrane 144 attached to swimming pool covering structure 142 so as to extend between the covering section 34 and the top surface 12 of the volume of liquid 14 when the covering section 34 is deployed over the top surface 12. Preferably, the solar membrane 144 is releasably attached to the covering section 34 using a solar membrane-to-covering section attachment means.

Typically, the solar membrane-to-covering section attachment means includes at least two and preferably a plurality of solar membrane-to-covering section attachment units 146. Each solar membrane-to-covering section attachment unit 146 typically includes releasably and cooperatively attachable male and female attachment components 148, 150.

The male and female attachment components 148, 150 are respectively attached using corresponding male and female attachment strips 152, 154 to either one of the solar membrane 144 or the covering section 34.

It should be understood that although FIG. 13 illustrates the male attachment component 148 attached to the solar membrane 144 and the female attachment component 150 attached to the covering section 34, the male attachment component(strip) 152 could be attached to the covering section 34 and the female attachment component 150 to the solar membrane 144 without departing from the scope of the present invention.

Preferably, the solar membrane 144 is a foldable solar membrane allowing the solar membrane 144 to float on the top surface 12 of the body of water 14. At least one and preferably all of the attachment strips 152, 154 are provided with strip length adjustment means for allowing adjustment of the length thereof so as to allow the solar membrane 144 to remain attached to the covering section 34 when the solar membrane 144 is floating on the top surface 12 of the body of water 14 and a covering section 34 is in substantially overlying and spaced relationship relative to the solar membrane 144.

The embodiments of the invention in which an exclusive privilege or property is claimed are defined as follows:

1. A swimming pool covering structure for covering a top surface of a volume of liquid contained within a swimming pool, said swimming pool having a pool bottom wall and a pool peripheral wall extending from said pool bottom wall, said pool peripheral wall defining a peripheral wall inner surface and a peripheral wall top edge, said swimming pool also defining an outer structural component positioned outwardly relative to said peripheral wall top edge in a substantially fixed relationship relative to said pool peripheral wall, said swimming pool covering structure comprising:

a substantially flexible covering section, said covering section being configured and sized for extending substantially across said top surface, said covering section defining a covering section outer peripheral edge;

a substantially flexible anchoring section, said anchoring section being configured and sized for extending peripherally and outwardly from said covering section, said anchoring section defining an anchoring section inner peripheral edge and an anchoring section outer peripheral edge, said covering and anchoring sections being separable from each other about a separation segment;

a covering-to-anchoring section releasable attachment means extending between said covering and anchoring sections about said separation segment for releasably attaching said covering and anchoring sections together about said separation segment;

anchoring means attached to said anchoring segment for anchoring said anchoring segment to said outer structural component.

2. A swimming pool covering structure as recited in claim 1 wherein said covering section defines a covering section central segment and a covering section flange positioned peripherally relative to said covering section central segment, said covering section flange extending from said covering section central segment to said covering section outer peripheral edge.

3. A swimming pool covering structure as recited in claim 2 wherein said covering section central segment and said covering section flange are made out respectively of a central segment piece of material and of a distinct flange piece of material, said central segment piece of material and said flange piece of material being attached together using a central segment-to-flange attachment means.

4. A swimming pool covering structure as recited in claim 3 wherein said central segment-to-flange attachment means includes stitches extending between said central segment piece of material and said flange piece of material.

5. A swimming pool covering structure as recited in claim 4 wherein said covering section flange defines a flange inner peripheral edge positioned opposite said covering section outer peripheral edge;

said covering section central segment defining a central segment peripheral edge;

said covering section flange being folded on itself adjacent said flange inner peripheral edge, said covering section flange defining an inwardly directed first layer folding about an inner fold line into an outwardly directed second layer, said second layer folding about an outer fold line into an inwardly directed third layer, said first, second and third layers being substantially in register with each other;

said covering section central segment defining a central segment attachment area located adjacent said central segment peripheral edge, said central segment attachment area being sandwiched between said second and third layer;

said first, second and third layers and said central segment attachment area being attached together.

6. A swimming pool covering structure as recited in claim 5 wherein said first, second and third layers and said central segment attachment area are attached together using a first and a second pair of stitch lines.

7. A swimming pool covering structure as recited in claim 5 wherein said covering section central segment is made out of a substantially water permeable material.

8. A swimming pool covering structure as recited in claim 2 wherein said covering section central segment is made out of a substantially water permeable material.

9. A swimming pool covering structure as recited in claim 1 wherein said separation segment extends all around said covering section outer peripheral edge allowing said covering section to be fully detachable from said anchoring section.

10. A swimming pool covering structure as recited in claim 1 wherein said separation segment extends only partially along said covering section outer peripheral edge, said covering and anchoring segments being linked together about a linking segment extending therebetween.

11. A swimming pool covering structure as recited in claim 10 wherein said linking segment extends integrally between said covering and anchoring segments.

12. A swimming pool covering structure as recited in claim 1 further comprising a releasable locking means operatively coupled to said covering-to-anchoring section releasable attachment means for releasably locking said covering section to said anchoring section.

13. A swimming pool covering structure as recited in claim 1 further comprising a protective means positioned adjacent said covering-to-anchoring section releasable attachment means for substantially protecting said covering-to-anchoring section releasable attachment means against environmental agents.

14. A swimming pool covering structure as recited in claim 13 wherein said protective means is positioned, configured and sized so as to releasably cover said covering-to-anchoring section releasable attachment means; whereby said protective means also acts as a contact prevention means for at least partially preventing contact between an intended user and said covering-to-anchoring section releasable attachment means and as an esthetic enhancing means for enhancing the visual aspect of said swimming pool covering structure.

15. A swimming pool covering structure as recited in claim 1 wherein said covering-to-anchoring section releasable attachment means includes a zip-fastener, said zip-fastener including a first and a second flexible zipper strip respectively attached to said covering and anchoring sections, said first and second zipper strips respectively having interlocking first and second zip projections extending therefrom, said zip-fastener also including a pull tab component operatively connected to said first and second zip projections for opening and closing said zip-fastener by sliding said pull tab component along said first and second zipper strips.

16. A swimming pool covering structure as recited in claim 15 wherein said zip-fastener includes a pair of pull tab components and wherein said covering-to-anchoring section releasable attachment means is further provided with a pull tab releasable locking means for releasably locking said pull tabs together when said zip-fastener is closed.

17. A swimming pool covering structure as recited in claim 15 further comprising a covering flap attached thereto adjacent said zip-fastener for selectively covering said first and second zip projections.

18. A swimming pool covering structure as recited in claim 1 further comprising a solar membrane attached thereto so as to extend between said covering section and said top surface of said volume of liquid when said covering section is deployed over said top surface of said volume of liquid.

19. A swimming pool covering structure as recited in claim 18 wherein said solar membrane is releasably attached to said covering section using a solar membrane-to-covering section attachment means.

20. A swimming pool covering structure as recited in claim 19 wherein said solar membrane-to-covering section attachment means includes at least two solar membrane-to-covering section attachment units, each solar membrane-to-covering section attachment unit including releasably and cooperatively attachable male and female attachment components, said male and female attachment components being respectively attached using corresponding male and female attachment strips to either one of said solar membrane or covering section.

21. A swimming pool covering structure as recited in claim 20 wherein said solar membrane is a floatable solar membrane allowing said solar membrane to float on said top surface of said body of water; at least one of said attachment strips being provided with strip length adjustment means for allowing adjustment of the length thereof so as to allow said solar membrane to remain attached to said covering section when said solar membrane is floating on said top surface of said body of water and said covering section is in a substantially overlying and spaced relationship relative to said solar membrane.

22. A swimming pool covering structure as recited in claim 20 wherein said covering section defines a covering section central segment and a covering section flange positioned peripherally relative to said covering section central segment, said covering section flange extending from said covering section central segment to said covering section outer peripheral edge; said covering section central segment and said covering section flange being made out respectively of a central segment piece of material and of a distinct flange piece of material, said central segment piece of material and said flange piece of material being attached together using a central segment-to-flange attachment means; said solar membrane-to-covering section attachment means includes at least two solar membrane-to-covering section attachment units, each solar membrane-to-covering section attachment unit including releasably and cooperatively attachable male and female attachment components, said male and female attachment components being respectively attached using corresponding male and female attachment strips to either one of said solar membrane or said covering section flange; said solar membrane being a floatable solar membrane allowing said solar membrane to float on said top surface of said body of water; at least one of said attachment strips being provided with strip length adjustment means for allowing adjustment of the length thereof so as to allow said solar membrane to remain attached to said covering section flange when said solar membrane is floating on said top surface of said body of water and said covering section is in a substantially overlying and spaced relationship relative to said solar membrane.

23. A swimming pool covering structure as recited in claim 1 wherein said anchoring section defines an anchoring section proximal segment located proximally relative to said covering section and an anchoring component distal segment located distally relative to said covering section; said anchoring section proximal and distal segments being foldable relative to each other about a proximal-to-distal segment fold line; said anchoring section being configured and sized so as to be folded about said proximal-to-distal segment fold line with said anchoring section distal segment located below said peripheral wall top edge when said anchoring section is attached to said outer structural component.

24. A swimming pool covering section as recited in claim 1 wherein said anchoring means includes at least two anchoring apertures formed in said anchoring section for receiving corresponding anchoring components extending from said outer structural component.

25. A swimming pool covering section as recited in claim 1 wherein said anchoring means includes at least two anchoring components attachable to said outer structural component, each of said anchoring components being provided with an anchoring component base for attachment to said outer structural component and with an anchoring component pin extending from said anchoring component base, said anchoring means further including at least two anchoring apertures extending through said anchoring section for individually receiving a corresponding one of said anchoring component pins.

26. A swimming pool covering structure as recited in claim 1 wherein said anchoring means includes at least two pairs of anchoring components attachable to said outer structural component, each of said anchoring component being provided with an anchoring component base for attachment to said outer structural component and with an anchoring component pin extending from said anchoring component base, each of said pairs including an anchoring component having a generally rectilinear anchoring component pin and an anchoring component having a substantially "S"-shaped configuration, said anchoring means further including at least two pairs of anchoring apertures extending through said anchoring section for receiving said anchoring component pins.

27. A swimming pool covering structure as recited in claim 1 wherein said anchoring means includes a first anchoring hook extending from an undersurface of said anchoring section and a second anchoring hook attached to said outer structural component, said first and second anchoring hooks being configured and sized for releasable attachment together.

28. A swimming pool covering structure as recited in claim 27 wherein said first anchoring hook includes a first hook base attached to said underside of said anchoring section and a generally "U"-shaped hooking segment extending from said first hook base; said second anchoring hook including a generally cylindrical second hook base insertable within said outer structural component, said second anchoring hook also having an anchoring prong attached to said second hook base for releasable attachment to said generally "U"-shaped hooking segment.

29. A swimming pool covering structure as recited in claim 28 wherein said cylindrical second hook base defines a generally flat second hook base top surface, said second hook base top surface being provided with a cylinder recess formed therein, said anchoring prong being pivotally attached to said second hook base within said cylinder recess for pivotal movement between a prong locking configuration wherein said anchoring prong is in a substantially parallel relationship relative to said second hook base top surface and a prong unlocking configuration wherein said anchoring prong is in a substantially angled relationship relative to said second hook base top surface, the position, configuration and shape of said anchoring prong preventing the protrusion thereof from said second hook base top surface when in both said prong locking and unlocking configurations.

30. A swimming pool covering structure as recited in claim 1 wherein said anchoring section defines an anchoring section proximal segment located proximally relative to said covering section and an anchoring component distal segment located distally relative to said covering section; said anchoring section proximal and distal segments being foldable relative to each other about a proximal-to-distal segment fold line; said anchoring section being configured and sized so as to be folded about said proximal-to-distal segment fold line with said anchoring section distal segment located below said peripheral wall top edge when said anchoring section is attached to said outer structural component; said anchoring section distal segment being provided with at least two anchoring tongues extending outwardly therefrom; said anchoring means including at least two pairs of anchoring apertures extending through said anchoring section for receiving said anchoring component pins, a first one of said anchoring apertures part of each of said pairs of anchoring apertures being positioned in a corresponding anchoring tongue while a second one of said anchoring apertures part of each of said pairs of anchoring apertures is positioned substantially in register a corresponding first anchoring aperture and is also positioned substantially adjacent said proximal-to-distal segment fold line.

31. A swimming pool covering structure as recited in claim 1 wherein said anchoring section is provided with at least two anchoring tongues extending outwardly therefrom.

32. A swimming pool covering structure as recited in claim 1 wherein said covering section, said anchoring section, said covering-to-anchoring section releasable attachment means and said anchoring means are all designed so as to be able to withstand the fall of at least one person thereon without allowing said one person to contact said top surface of said volume of liquid.

33. In combination, a swimming pool and a swimming pool covering structure for covering a top surface of a volume of liquid containable within said swimming pool, said swimming pool having a pool bottom wall and a pool peripheral wall extending from said pool bottom wall, said pool peripheral wall defining a peripheral wall inner surface and a peripheral wall top edge, said swimming pool also defining an outer structural component positioned outwardly relative to said peripheral wall top edge in a substantially fixed relationship relative to said pool peripheral wall, said swimming pool covering structure comprising:

a substantially flexible covering section, said covering section being configured and sized for extending substantially across said top surface, said covering section defining a covering section outer peripheral edge;

a substantially flexible anchoring section, said anchoring section being configured and sized for extending peripherally and outwardly from said covering section, said anchoring section defining an anchoring section inner peripheral edge and an anchoring section outer peripheral edge, said covering and anchoring sections being separable from each other about a separation segment;

a covering-to-anchoring section releasable attachment means extending between said covering and anchoring sections about said separation segment for releasably attaching said covering and anchoring sections together about said separation segment;

anchoring means attached to said anchoring segment for anchoring said anchoring segment to said outer structural component.

34. A swimming pool covering structure as recited in claim 32 wherein said covering section defines a covering section central segment and a covering section flange positioned peripherally relative to said covering section central segment, said covering section flange extending from said covering section central segment to said covering section outer peripheral edge.

35. A combination as recited in claim 33 wherein said swimming pool is an above-ground swimming pool.

36. A combination as recited in claim 35 wherein said swimming pool is an inflatable swimming pool.

37. A combination as recited in claim 33 wherein said swimming pool is an in-ground swimming pool.

* * * * *